US008335330B2

(12) United States Patent
Usher

(10) Patent No.: US 8,335,330 B2
(45) Date of Patent: Dec. 18, 2012

(54) METHODS AND DEVICES FOR AUDIO UPMIXING

(75) Inventor: John Usher, Montreal (CA)

(73) Assignee: Fundacio Barcelona Media Universitat Pompeu Fabra, Barcelona (ES)

( * ) Notice: Subject to any disclaimer, the term of this patent is extended or adjusted under 35 U.S.C. 154(b) by 1311 days.

(21) Appl. No.: 11/843,055

(22) Filed: Aug. 22, 2007

(65) Prior Publication Data

US 2008/0137887 A1 Jun. 12, 2008

Related U.S. Application Data

(60) Provisional application No. 60/823,156, filed on Aug. 22, 2006.

(51) Int. Cl.
*H04R 5/02* (2006.01)

(52) U.S. Cl. ..... 381/300; 381/313; 381/17; 381/59; 381/18; 381/303; 379/406.01; 379/406.16

(58) Field of Classification Search ..... 381/313, 381/17, 59, 303, 307, 96, 27, 28, 103, 71.1, 381/71.4, 2, 5, 10, 18; 379/406.01–406.16
See application file for complete search history.

(56) References Cited

U.S. PATENT DOCUMENTS

| | | | | |
|---|---|---|---|---|
| 6,246,773 | B1 * | 6/2001 | Eastty | 381/71.11 |
| 6,405,163 | B1 * | 6/2002 | Laroche | 704/205 |
| 6,421,447 | B1 * | 7/2002 | Chu | 381/18 |
| 6,496,584 | B2 | 12/2002 | Irwan et al. | |
| 6,614,910 | B1 * | 9/2003 | Clemow et al. | 381/1 |
| 6,882,731 | B2 | 4/2005 | Irwan et al. | |
| 7,107,211 | B2 | 9/2006 | Griesinger | |
| 7,356,152 | B2 * | 4/2008 | Vernon et al. | 381/119 |
| 7,522,733 | B2 * | 4/2009 | Kraemer et al. | 381/1 |
| 7,650,000 | B2 * | 1/2010 | Kawana et al. | 381/17 |
| 7,764,805 | B2 * | 7/2010 | Tomita et al. | 381/307 |

(Continued)

FOREIGN PATENT DOCUMENTS

EP 1507441 2/2005

(Continued)

OTHER PUBLICATIONS

Li et al,An Unsupervised Adaptive Filtering Approach of 2-5 Channel Upmix,AES,Oct. 2005.*

(Continued)

*Primary Examiner* — Davetta W Goins
*Assistant Examiner* — Kuassi Ganmavo
(74) *Attorney, Agent, or Firm* — Renner, Otto, Boisselle & Sklar, LLP

(57) ABSTRACT

At least one exemplary embodiment is directed to a new spatial audio enhancing system including a novel Adaptive Sound Upmixing System (ASUS). In some specific embodiments the ASUS provided converts a two-channel recording into an audio signal including four channels that can be played over four different loudspeakers. In other specific embodiments the ASUS provided converts a two-channel recording into an audio signal including five channels that can be played over five different loudspeakersn even other specific embodiments the ASUS provided converts a five-channel recording (such as those for DVD's) into an audio signal including eight channels that can be played over eight different loudspeakers. More generally, in view of this disclosure those skilled in the art will be able to adapt the ASUS to process and provide an arbitrary number of audio channels both at the input and the output.

18 Claims, 6 Drawing Sheets

U.S. PATENT DOCUMENTS

| | | | | |
|---|---|---|---|---|
| 7,920,711 | B2 * | 4/2011 | Takashima et al. | 381/307 |
| 2005/0008170 | A1 * | 1/2005 | Pfaffinger et al. | 381/96 |
| 2006/0093164 | A1 * | 5/2006 | Reams et al. | 381/119 |
| 2007/0041592 | A1 * | 2/2007 | Avendano et al. | 381/99 |

FOREIGN PATENT DOCUMENTS

| | | | | |
|---|---|---|---|---|
| JP | 06217400 | A | * | 8/1994 |
| JP | 6335093 | | | 12/1994 |
| JP | 10056699 | A | * | 2/1998 |
| JP | 2004266692 | A | * | 9/2004 |
| JP | 2006217210 | | | 8/2006 |

OTHER PUBLICATIONS

Rumsey et al, Investigation Into the Effect of Interchannel Crosstalk in Multichannel Microphone Technique, AES,2005.*

"A new digital surround processing system for general A/V sources", Yeongha Choi, Seokwan Han, Ducksoo Lee and Koengmo Sung; IEEE Transactions on Consumer Electronics; vol. 41, No. 4; Nov. 1995.

"A frequency-domain approach to multichannel upmix", Avendano, Carlos and Jean-Marc Jot; J. Audio Eng. Soc.; vol. 52, No. 7/8; Jul./Aug. 2004.

"Old and new techniques for artificial stereophonic image enhancement", Maher, Robert C., Eric Lindermann and Jeffrey Barish; Journal of the Audio Engineering Society; Nov. 1996.

"Two-to-five channel sound processing", Irwan, R. and Ronald M. Aarts; J. Audio Eng. Soc.; vol. 50, No. 11; Nov. 2002.

* cited by examiner

METHODS AND DEVICES FOR AUDIO UPMIXING

CROSS-REFERENCE TO RELATED APPLICATIONS

This application claims the benefit of U.S. provisional patent application No. 60/823,156 filed on 22 Aug. 2006. The disclosure of which is incorporated herein by reference in its entirety.

FIELD OF THE INVENTION

The invention relates to methods of enhancing audio imagery, and, in particular, though not exclusively, to audio upmixing methods and devices.

BACKGROUND OF THE INVENTION

The quality of loudspeaker audio has been increasing at a steady rate for over a century. In terms of timbre, there is a strong argument for saying recreation of a recorded sound is as good as it is going to get. However, the aspects of spatial quality have some way to go before an analogous plateau is reached. This discrepancy is due to the relatively recent arrival of multi-channel audio systems for home and vehicle use, providing the methods to reproduce sound in a way that seems engaging and aesthetically "natural." Yet the vast majority of our musical recordings are stored with a two-channel stereo format that is recorded using two microphones.

There have been attempts at processing two-channel recordings so as to derive additional channels that contain reverberance information that can be played in an audio system including more than two loudspeakers. Such upmixing systems can be classified as spatial audio enhancers. Moreover, the goal of a commercial loudspeaker spatial audio system for music reproduction is to generally increase the enjoyment of the listening experience in a way that the listener can describe in terms of spatial aspects of the perceived sound. More generally, spatial audio enhancers take an audio recording, including one or more channels, and produce additional channels in order to enhance audio imagery. Examples, of previously developed spatial audio enhancers include the Dolby Pro Logic II™ system, the Maher "spatial enhancement" system, the Aarts/Irwan upmixer 2-to-5 channel upmixer, the Logic 7 2-to-7 upmixer and the Avendano/Jot upmixer.

SUMMARY OF THE INVENTION

At least one exemplary embodiment of the invention is related to a method of up-mixing a plurality of audio signals comprising: filtering one, a first one, of the plurality of audio signals with respect to a respective set of filtering coefficients generating a filtered first one; time-shifting a second, a second one, of the plurality of audio signals with respect to the filtered first one, generating a shifted second one; determining a respective first difference between the filtered first one and the shifted second one, wherein the respective first difference is an up-mixed audio signal; and adjusting the respective set of filtering coefficients based on the respective first difference so that the respective first difference is essentially orthogonal (i.e., about a zero correlation) to the first one.

In at least one exemplary embodiment each of the plurality of audio signals can include a source image component and a reverberance image component, where at least some of the respective source image components included in the plurality of audio signals are correlated with one another. In at least one further exemplary embodiment the plurality of audio signals includes a left front channel and a right rear channel and the respective first difference corresponds to a left rear channel including some portion of the respective reverberance image of the left front and right front channels.

At least one exemplary embodiment is directed to a method comprising: filtering the second one with respect to another respective set of filtering coefficients; time-shifting the first one with respect to the filtered second one, generating a shifted first one; determining a respective second difference between the filtered second one and the shifted first one; and, adjusting the another respective set of filtering coefficients based on the respective second difference so that the respective second difference is essentially orthogonal to the second one, and wherein the respective second difference corresponds to a right rear channel including some portion of the respective reverberance image of the left front and right front channels.

In at least one exemplary embodiment the first and second audio signals are adjacent audio channels.

In at least one exemplary embodiment the time-shifting includes one of delaying or advancing one audio signal with respect to another. In at least one exemplary embodiment a time-shift value is in the approximate range of 2 ms-10 ms.

In at least one exemplary embodiment the filtering of the first one includes equalizing the first one such that the respective difference is minimized. The respective set of filtering coefficients can also be adjusted according to one of the Least Means Squares (LMS) method or Normalized LMS (NLMS) method.

At least one exemplary embodiment is directed to a method comprising: determining a respective level of panning between a first and second audio signal; and, introducing cross-talk between the first and second audio signals if the level of panning is considered hard. For example, in at least one exemplary embodiment, the level of panning is considered hard if the first and second audio signals are essentially uncorrelated.

At least one exemplary embodiment is directed to a computer program including a computer usable program code configured to create at least one reverberance channel output from a plurality of audio signals, the computer usable program code including program instructions for: filtering the first one with respect to a respective set of filtering coefficients; time-shifting the second one with respect to the filtered first one; determining a respective first difference between the filtered first one and the time-shifted second one, where the respective first difference is a reverberance channel; and, adjusting the respective set of filtering coefficients based on the respective first difference so that the respective first difference is essentially orthogonal to the first one.

In at least one exemplary embodiment, the plurality of audio signals includes a left front channel and a right rear channel and the respective first difference corresponds to a left rear channel including some portion of the respective reverberance image of the left front and right front channels. In at least one exemplary embodiment, the computer usable program code also includes program instructions for: filtering the second one with respect to another respective set of filtering coefficients; time-shifting the first one with respect to the filtered second one of the plurality audio signals; determining a respective second difference between the filtered second one and the time-shifted first one; and, adjusting the another respective set of filtering coefficients based on the respective second difference so that the respective second difference is essentially orthogonal to the first one, and where the respective second difference corresponds to a right rear channel including some portion of the respective reverberance image of the left front and right front channels.

In at least one exemplary embodiment a device including the computer program also includes at least one port for receiving the plurality of audio signals.

In at least one exemplary embodiment a device including the computer program also includes a plurality of outputs for providing a respective plurality of output audio signals that includes some combination of the original plurality of audio signals and at least one reverberance channel signal.

In at least one exemplary embodiment a device including the computer program also includes a data storage device for storing a plurality of output audio signals that includes some combination of the original plurality of audio signals and at least one reverberance channel signal.

In at least one exemplary embodiment a device including the computer program also includes: a hard panning detector; a cross-talk inducer; and, where the computer usable program code also includes program instructions for employing the cross-talk inducer to inject cross-talk into some of the plurality of audio signals if hard panning is detected.

At least one exemplary embodiment is directed to creating an modified audio channel comprising: a plurality of audio channels including a first audio channel, a second audio channel and a third audio channel, wherein the third audio channel is a combination of the first and second audio channels produced by: filtering the first audio channel with respect to a respective set of filtering coefficients; time-shifting the second audio channel with respect to the filtered first audio channel; creating the third audio channel by determining a respective first difference between the filtered first audio channel and the time-shifted second audio channel, where the respective first difference is the third audio channel; and, adjusting the respective set of filtering coefficients based on the respective first difference so that the third audio channel is essentially orthogonal to the first audio channel.

Further areas of applicability of exemplary embodiments of the present invention will become apparent from the detailed description provided hereinafter. It should be understood that the detailed description and specific examples, while indicating exemplary embodiments of the invention, are intended for purposes of illustration only and are not intended to limited the scope of the invention.

BRIEF DESCRIPTION OF THE DRAWINGS

Exemplary embodiments of present invention will become more fully understood from the detailed description and the accompanying drawings, wherein.

DETAILED DESCRIPTION OF THE INVENTION

Figure 1:
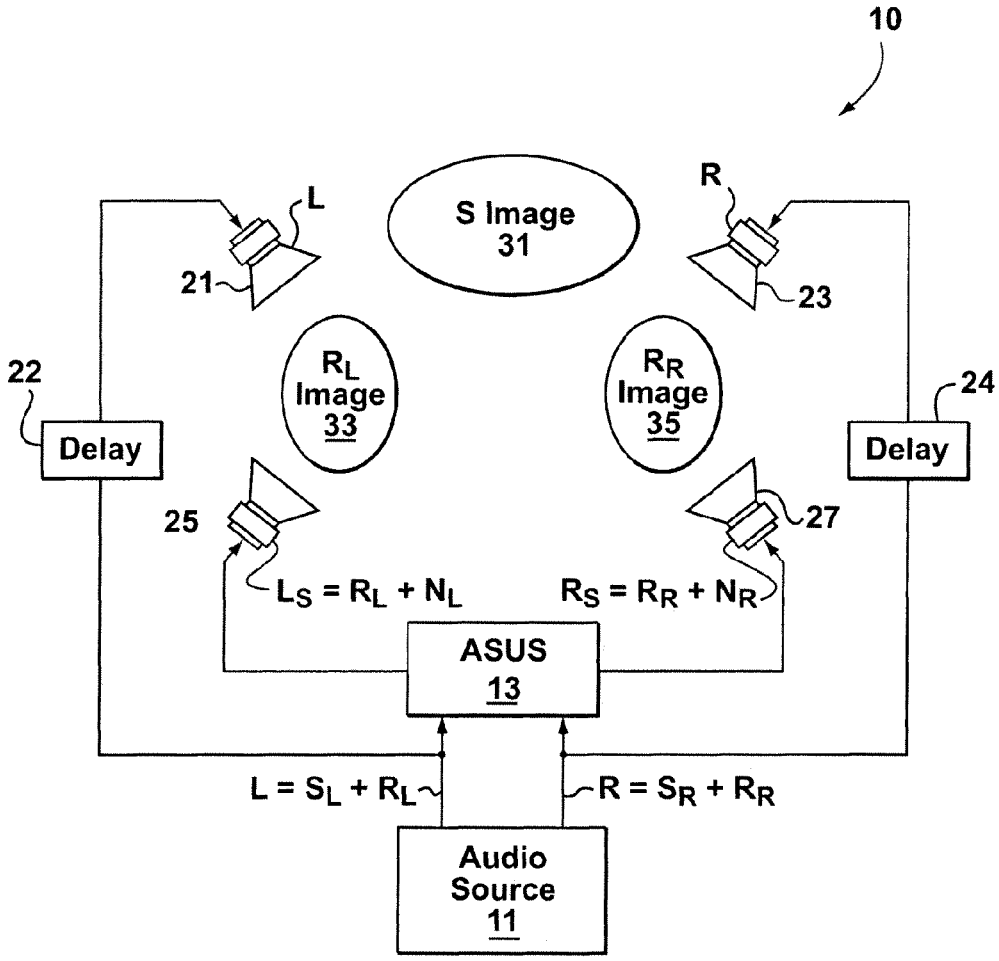
FIG. 1 is a simplified schematic illustration of a surround sound system including an Adaptive Sound Upmix System (ASUS) in accordance with at least one exemplary embodiment.

The following description of exemplary embodiment(s) is merely illustrative in nature and is in no way intended to limit the invention, its application, or uses.

Exemplary embodiments are directed to or can be operatively used on various wired or wireless audio devices. Additionally, exemplary embodiments can be used with digital and non-digital acoustic systems. Additionally various receivers and microphones can be used, for example MEMs transducers, diaphragm transducers, for examples Knowle's FG and EG series transducers.

Processes, techniques, apparatus, and materials as known by one of ordinary skill in the art may not be discussed in detail but are intended to be part of the enabling description where appropriate. For example the correlation of signals and the computer code to check correlation is intended to fall within the scope of at least one exemplary embodiment.

Notice that similar reference numerals and letters refer to similar items in the following figures, and thus once an item is defined in one figure, it may not be discussed or further defined in the following figures.

At least one exemplary embodiment is directed to a new spatial audio enhancing system including a novel Adaptive Sound Upmixing System (ASUS). In some specific exemplary embodiments the ASUS provided converts a two-channel recording into an audio signal including four channels that can be played over four different loudspeakers. In other specific exemplary embodiments the ASUS provided converts a two-channel recording into an audio signal including five channels that can be played over five different loudspeakers. In even other specific embodiments the ASUS provided converts a five-channel recording (such as those for DVD's) into an audio signal including eight channels that can be played over eight different loudspeakers. More generally, in view of this disclosure those skilled in the art will be able to adapt the ASUS to process and provide an arbitrary number of audio channels both at the input and the output.

In at least one exemplary embodiment, the ASUS is for sound reproduction, using multi-channel home theater or automotive loudspeaker systems, where the original recording has fewer channels than those available in the multi-channel system. Multi-channel systems typically have four or five loudspeakers. However, keeping in mind that two-channel recordings are created using two microphones, an underlying aspect of the invention is that the audio imagery created be consistent with that in a conventional two-loudspeaker sound scene created using the same recording. The general maxim governing the reproduction of a sound recording is that the mixing intentions of the sound engineer are to be respected. Accordingly, in some exemplary embodiments of the invention the aforementioned general maxim translates into meaning that the spatial imagery associated with the recorded musical instruments remains essentially the same in the upmixed sound scene. The enhancement is therefore in terms of the imagery that contributes to the listeners' sense of the recording space, which is known as reverberance imagery. In quantitative terms the reverberance imagery is generally considered the sound reflections impinging on a point that can be modeled as a stochastic ergodic function, such as random noise. Put another way, at least one exemplary embodiment is arranged so that in operation there is an attempt made to substantially separate and independently deliver to a listener all those reverberance components from a recording of a live musical performance that enable the listener to describe the perception of reverberance.

Features of at least one exemplary embodiment can be embodied in a number of forms. For example, various features can be embodied in a suitable combination of hardware, software and firmware. In particular, some exemplary embodiments include, without limitation, entirely hardware, entirely software, entirely firmware or some suitable combination of hardware, software and firmware. In at least one exemplary embodiment, features can be implemented in software, which includes but is not limited to firmware, resident software, microcode, etc.

Additionally and/or alternatively, features can be embodied in the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

A computer-readable medium can be an electronic, magnetic, optical, electromagnetic, infrared, or semiconductor system (or apparatus or device) or a propagation medium. Examples of a computer-readable medium include a semiconductor and/or solid-state memory, magnetic tape, a removable computer diskette, a random access memory (RAM), a read-only memory (ROM), a rigid magnetic disk and an optical disk. Current examples of optical disks include, without limitation, compact disk-read only memory (CD-ROM), compact disk-read/write (CD-R/W) and DVD.

In accordance with features of at least one exemplary embodiment, a data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output (i.e. I/O devices)—including but not limited to keyboards, displays, pointing devices, etc. —can be coupled to the system either directly or through intervening I/O controllers.

Network adapters may also be coupled to the system to enable communication between multiple data processing systems, remote printers, or storage devices through intervening private or public networks. Modems, cable modems and Ethernet cards are just a few of the currently available types of network adapters.

Referring to FIG. 1, shown is a simplified schematic illustration of a surround sound system 10 including an Adaptive Sound Upmix System (ASUS) 13 in accordance with features of at least one exemplary embodiment. Those skilled in the art will understand that a workable surround sound system also includes a suitable combination of associated structural elements, mechanical systems, hardware, firmware and software that is employed to support the function and operation of the surround sound system. Such items include, without limitation, wiring, sensors, regulators, mounting brackets, and electromechanical controllers. Hereinafter only those items relating to features specific to at least one exemplary embodiment will be described.

More specifically, in addition to the ASUS 13 the surround sound system 10 includes an audio source 11, respective left and right front speakers 21 and 23, respective left and right rear speakers 25 and 27, and respective left and right delay elements 22 and 24.

The left and right delay elements 22 and 24 are respectively connected between the audio source 11 and the left and right from speakers 21 and 23 so that the left (L) and right (R) audio channels are delivered to the left and right front speakers. The left (L) and right (R) audio channels are also coupled to the ASUS 13, which performs the upmixing function to produce left reverberance ($L_S$) and right reverberance ($R_S$) channels that are in turn delivered to the left and right rear speakers 25 and 27.

In operation, the ASUS 13 receives the left (L) and right (R) audio channels and produces the new left reverberance ($L_S$) and right reverberance ($R_S$) channels, which are not a part of the original two-channel recording. In turn, each of the as the speakers 21, 23, 25 and 27 is provided with a corresponding one of the respective audio channels [L, R, $L_S$, $R_S$] and auditory images are created. Specifically, a first auditory image corresponds to a source image 31 produced primarily by the left and right front speakers 21 and 23; a second auditory image corresponds to a first reverberance image 33 produced primarily by the left front and left rear speakers 21 and 25; and, a third auditory image corresponds to a second reverberance image 35 produced primarily by the right front and right rear speakers 23 and 27.

With continued reference to FIG. 1, subjective design criteria for the ASUS 13 can be translated into a set of criteria that can be evaluated using electronic measurements. The criteria can be divided into two categories: those which concern source imagery and those which concern reverberance imagery. To describe how to realize these goals in signal processing terms the input signals to the ASUS is modeled as two parts: a part which affects spatial aspects of the source imagery and a part that affects spatial aspects of reverberance imagery. How these two parts are distinguished in electronic terms is discussed below with reference to the signal model shown in FIGS. 2A and 2B.

For now, with reference to FIG. 1 only, these two electronic components of the input signals are simply called the Source (image) component and the Reverberance (image) component. In the left channel, these components are abbreviated to SL and RL, and in the right channel SR and RR. This is just an abstract representation to make the foregoing translation of the subjective performance criteria to the electronic criteria easier. Other sound components which do not contribute to S or R imagery, i.e. noise in the recording environment from a source other than the musical instrument, are assumed to be absent or at least very low in level. Therefore the two input signals (e.g. the left and right channels from a CD player) can simply be modeled as the sum of these two sound components as summarized in FIG. 1.

According to the principles of pair-wise panning if the source components SL and SR are coherent (i.e. with a high absolute cross-correlation peak at a lag less than about 1 ms) then radiation of these signals with two loudspeakers either in front (as with a conventional 2/0 loudspeaker system) or to the side of the listener will create a phantom source image 31 between the speakers 21 and 23. The same applies to the radiation of the reverberance components; so if RS could be extracted from the right channel and radiated from the rear-right speaker 27, a listener would perceive the second reverberance image 35 on the right-hand side, as shown in FIG. 1. In an approximately idealized noise free (or at least, very low noise) recording environment, the reverberance image components can simply be defined by exclusion: they are those sound components of the two input signals which are not correlated. This general definition is limited with a frequency-time model.

The two subjective design criteria regarding source and reverberance imagery are now translated into a method which can be undertaken empirically on the output signals of the ASUS 13:

1. Spatial distortion of the source image in the upmixed scene can be minimized.

To maximize the source image fidelity in the upmixed audio scene, source image components Ls and Rs should not be radiated from the rear loudspeakers in the upmixed sound scene. If they were, then they could perceptually interact with the source image components radiated from the front loudspeakers and cause the source image to be distorted. Therefore, all those sound components which contribute to the formation of a source image should be removed from the rear loudspeaker signals, yet those source image components radiated from the front loudspeakers should be maintained. A way of measuring this in electronic terms is to ensure that the signal RS is uncorrelated with signal L, and that LS is uncorrelated with R. For a signal sampled at time n, this is mathematically expressed in (4.1):

$$0 \approx \sum_{n=-\infty}^{\infty} RS(n)L(n-k) \tag{4.1}$$

and $$0 \approx \sum_{n=-\infty}^{\infty} LS(n)R(n-k),$$

$$k = \pm 0, \pm 1, \pm 2, \ldots, \pm N.$$

The lag range N should be equal to 10-20 ms (500-1000 samples for a 44.1 kHz sample-rate digital system), as it is the early sound after the direct-path sound which primarily contributes to spatial aspects of source imagery (such as source width) and the latter part to reverberance imagery. For lag times (k) greater than 20 ms or so, the two signals may be somewhat correlated at low frequencies—as explained later.

2. Reverberance imagery should have a homogenous distribution in the horizontal plane; in particular, reverberance image directional strength should be high from lateral (+90 degrees) directions.

The implication of this statement is that in order to create new reverberance images to the side of the listener, the side loudspeaker channels (e.g. R and RS) should have some degree of correlation. Under such circumstances, pair-wise amplitude panning could occur between the two loudspeakers; with the perceptual consequence that the reverberance image would be pulled away from the side loudspeakers and to a region between them. This is summarized in (4.2):

$$0 \neq \sum_{n=-\infty}^{\infty} LS(n)L(n-k) \tag{4.2}$$

and $$0 \neq \sum_{n=-\infty}^{\infty} RS(n)R(n-k),$$

$$k = \pm 0, \pm 1, \pm 2, \ldots, \pm N.$$

Again, N would be equal to 10-20 ms in many embodiments.

Regarding the degree of correlation between the two rear channels (i.e. the "extracted ambiance" signals), the optimal relationship is not as straightforward as with the above two electronic criteria. Although low-frequency interaural coherence is conducive for enveloping, close-sounding and wide auditory imagery, this does not necessarily mean the rear loudspeaker channels should be uncorrelated de facto. The correlation between two locations in a reverberant field is dependant on the distance between them and is frequency dependant. For instance, at 100 Hz the measuring points in a reverberant field must by approximately 1.7 m apart to have a coherence of zero (assuming the Schroeder frequency of the hall is less than 100 Hz). Microphone-pair recordings in concert halls therefore rarely have total decorrelation at low-frequencies. Furthermore, for sound reproduced with a loudspeaker pair in normal echoic rooms, due to loudspeaker cross-talk head diffraction and room reflections, the interaural coherence at low frequencies is close to unity regardless of the interchannel coherence of the loudspeaker signals.

Figure 2A:
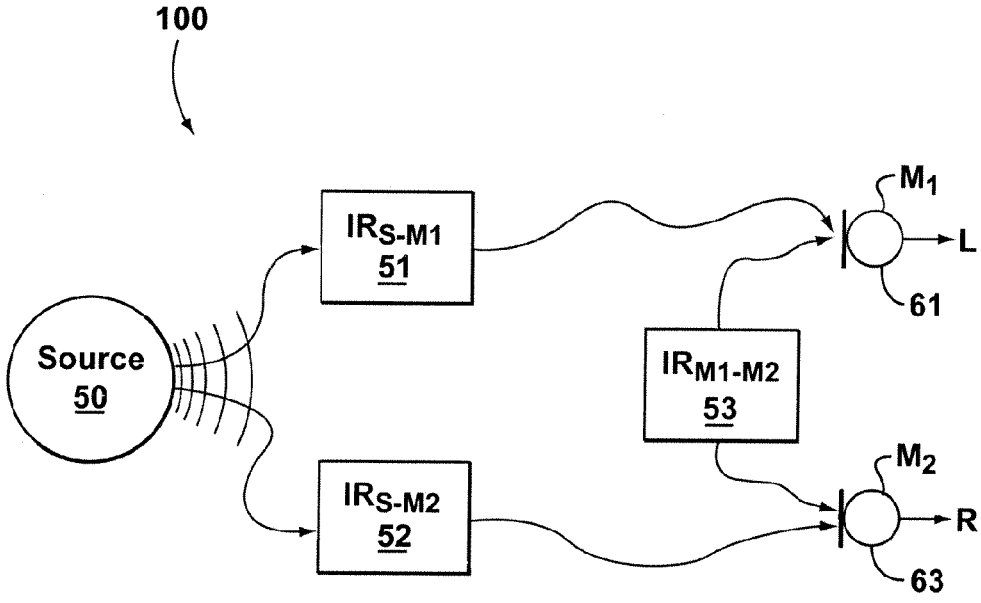
FIG. 2A is a simplified schematic illustration of a two microphone recording system.

Before describing a specific exemplary embodiment of the novel ASUS 13 provided in accordance with features of at lest one exemplary embodiment, it is useful to first look at the impulse response model of an example recording environment. Turning to FIG. 2A, shown is a simplified schematic illustration of a two microphone recording system 100. The system 100 includes an audio source 50 (e.g. a musical instrument, a group of instruments, one or more vocalists, etc.) and two microphones M1 61 and M2 63. The impulse response blocks 51, 52 and 53 represent the corresponding quantized and approximated impulse responses of the sound channels between: the source 50 and the microphone M1 61; the source 50 and the microphone M2 63; and between the two microphones M1 61 and M2 63.

As noted above the ASUS 13 can be adapted for any number input channels (>2) In the description of the ASUS 13 herein, it is assumed that the two input signals are directly from the microphone pair M1 61 and M2 63; therefore the recording media can be eliminated from the discussion to the time being. These two signals from each microphone at sample time n are $m_1(n)$ and $m_2(n)$. As discussed in the electronic design criteria, the goal of the ASUS 13 is to remove those sound-image components in the two mike signals which are correlated (i.e. the source image components) leaving the reverberance-image components to be radiated from the rear speakers 25 and 27 shown in FIGS. 1 and 2B. Therefore, if a function can be found which can be applied to one mike signal to make it electronically the same as the other (generally; in the frequency-domain this is called the transfer function and in the time-domain the impulse response), then the correlated sound components which contribute to source imagery can be removed by subtracting the two signals after one of these signals has been processed by this function. An overview of the signal processing structure is given in FIG. 2B which is described in greater detail below.

With continued reference to FIG. 2A, the impulse response (IR) between two locations in a concert hall can simply be measured by creating a large acoustic impulse—such as with popping a balloon—and measuring the pressure change at the other location using a microphone, an electronic amplifier and signal recorder. The instantaneous time-domain transfer function can only be measured with this "impulsive excitation" method if the onset of the impulse is instantaneous and a single sample in duration, shaped like a (scaled) Kronecker delta function. The IR obtained by measuring the voltage of the microphone output signal actually includes three separate IR's: the mechanical IR of the sound producing device; the acoustic transfer function—affected by both the air between the two locations and by sound reflecting objects in the room; and the electro-mechanical transfer function of the microphone, electronic signal processing and recording system; which is equivalent to a convolution of the three IR's.

The IR is affected by the level of the excitation signal due to non-linearities in the mechanical, electronic or acoustic parts involved in the IR measurement (e.g. an IR measured using loudspeakers is affected in a non-linear way by the signal level). An impulse response can also apply to the time-domain output of an (digital) electronic system when excited with a signal shaped liked a Kronecker delta function. Therefore, to avoid confusion the term acoustic impulse response will be used to refer to any impulse response which involves the transmission of the excitation signal through air, as distinguished from a purely electronic IR.

As noted above, in a recording of a solo musical performance using two microphones M1 61 and M2 63, there are three acoustic impulse responses 51, 52 and 53: the intermicrophone impulse response $IR_{m1-m2}$ 53; and the two impulse responses between the sound source and the two microphones 51 and 52 ($IR_{S-m1}$ and $IR_{S-m2}$). All three IR's can change due to various factors, and. these factors can be distinguished as being related to either the sound source or to its surrounding environment:

Movement of the sound source or microphones.

The instrument is not a point-source so there will generally be a different impulse response for different notes which are played (especially for large instruments such as a grand piano or church organ) due to the direction-dependant acoustic radiation pattern of the instrument (in other words—the impulse response will be frequency dependent). If a loudspeaker is used to create the excitation signal, the radiation pattern of the loudspeaker will affect the measured IR.

Air turbulence and temperature variations within the recording environment will affect all three impulse responses.

Physical changes in room boundary surfaces and moving objects (rotating fans, audience etc).

Clearly, the first two factors which affect the acoustic IR's in the above list are source-related and the second two are environment related, with the source-related factors only affecting the source-mike IR. These factors will be investigated later with a real-time system, however, the algorithm for the ASUS will be described for time-invariant IR's and stationary source signals. The word stationary here means that the statistical properties of the microphone signals (such as mean and autocorrelation) are invariant over time i.e. they are both strictly stationary and wide sense stationary. Of course, when dealing with live musical instruments the signals at the microphones are non-stationary; it will be shown later how time-varying signals such as recorded music affect the performance of the algorithm. Finally, for the time-being any sound in the room which is caused by sources other than our single source S is ignored; that is, a noise-free (or at least, very low noise) acoustic and electronic environment is assumed. For the foregoing analysis in this section, these three major assumptions are summarized:

Time invariant IR.

Stationary source statistics

Noise-free operating environment.

The time-domain acoustic transfer function between two locations in an enclosed space—in particular between a radiated acoustic signal and a microphone diaphragm—can be modeled as a two-part IR.

In this model the L-length acoustic IR is represented as two decaying time sequences: one of which is defined between sample times n=0 and $n=L_r-1$, the other between $n=L_r$ and n=L. The first of these sequences represents the IR from the direct sound and early-reflections (ER's), and the other sequence represents the reverberation: accordingly called the "direct-path" and "reverberant-path" components of the IR. In acoustical terms, reflected sound can be thought of as consisting of two parts: early reflections (ER's) and reverberation (reverb). ER.s are defined as "those reflections which arrive at the car via a predictable, non-stochastic directional path, generally within 80 ms of the direct sound" whereas reverberation is generally considered to be sound reflections impinging on a point (e.g. microphone) which can be modeled as a stochastic process, with a Gaussian distribution and a mean of zero.

The source signals involved in the described filtering processes are also modeled as discrete-time stochastic processes. This means a random process whose time evolution can (only) be described using probabilistic laws; it is not possible to define exactly how the process will evolve once it has started, but it can be modeled according to a number of statistical criteria.

As discussed; it is the direct-component of the IR which affects source imagery, such as perceived source direction, width and distance, and the reverberant-component which affects reverberance imagery, such as envelopment and feeling for the size of the room. The time boundary between these two components is called the mixing time: "The mixing time defines how long it takes for there to be no memory of the initial state of the system. There is statistically equal energy in all regions of the space in the concert hall) after the mixing time [creating a diffuse sound field]". The mixing time is approximated by (4.3):

$$L_r \approx \sqrt{V}(\text{ms}), \tag{4.3}$$

where V is the volume of the room (in $m^3$).

The mixing time can also be defined in terms of the local statistics of the impulse response. Individual, late-arriving sound reflections in a room impinging upon a point (say, a microphone capsule) will give a pressure which can be modeled as being statistically independent from each other; that is, they are independent identically distributed (IID). According to the central limit theorem, the summation of many IID signals gives a Gaussian distribution. The distribution can therefore be used as a basis for determining the mixing time.

After establishing the two-component acoustic IR model, the input signals m1($n$) and m2($n$) can be described by the acoustic convolution between the sound source s(n) and the Lr-length direct-path coefficients summed with the convolution of s(n) with the (L−Lr)-length reverberant-path coefficients. The convolution is undertaken acoustically but to simplify the mathematics we will consider that all signals are electronic as if there is a direct mapping of pressure to voltage, sampled at time (n). Furthermore, for simplicity the two microphone signals m1 and m2 are not referred to explicitly, instead each system is generalized using the subscripts i and j, where i or j=1 or 2 and i≠j. This convolution can therefore be written as:

$$m_i(n) = \sum_{k=0}^{L_r-1} s(n-k)d_{1,k} \sum_{l=L_r}^{L} s(n-l)\tau_{\xi,L_r-l_1} \quad i = 1 \text{ or } 2. \tag{4.4}$$

A vector formulation of the convolution in (4.4) is now developed, as vector representations of discrete summations are visually more simple to understand and will be used throughout this chapter to describe the ASUS. In-keeping with convention, vectors will always be represented as bold text, contrasted with the italic text style used to represent discrete signal samples in the time-domain.

As mentioned, the direct-path IR coefficients are the first Lr samples of the L-length IR between the source and two microphones, and the reverberant path IR coefficients are the remaining (L−Lr) samples of these IR's. The time-varying source samples and time-invariant IR's are now defined as the vectors:

$$s_d(n)=[s(n),s(n-1),\ldots,s(n-L_r+1)]^T$$

$$s_r(n)=[s(n-L_r),s(n-L_r-1),\ldots,s(n-L)]^T$$

$$d_i=[d_{i,o},d_i,\ldots,d_{i-1}]^T$$

$$r_i=[r_{i,o},r_i,\ldots,r_{i/L-L-1}]^T.$$

And the acoustic convolutions between the radiated acoustic source and the early and reverberant-path IR's in (4.4) can now be written as:

$$m_i(n)=s_d^T(n)d_i+s_r^T(n)r_i, \tag{4.5}$$

For convenience, the early and reverberant path convolutions are replaced with:

$$s_{di}(n)=s_d^T(n)d_i$$

and $$s_{ri}(n)=s_r^T(n)r_i, \tag{4.6}$$

So (4.5) becomes:

$$m_i(n)=s_{di}(n)+s_{ri}(n). \tag{4.7}$$

With the following definitions for the last L samples of the early and reverberant path sound arriving at time n:

$$s_{di}(n)=[s_{di}(n),s_{di}(n-1),\ldots,s_{di}(n-L+1)]^T$$

$$s_{ri}(n)=[s_{ri}(n),s_{ri}(n-1),\ldots,s_{ri}(n-L+1)]^T,$$

the following assumptions about these early and reverberant path sounds are expressed using the statistical expectation operator E {.}:

The early part of both IR's ("direct-path") are at least partially correlated:

$$E\{d_i^T(n)d_j(n)\}\neq 0,$$

$$E\{s_{di}^T(n)s_{dj}(n)\}\neq 0,$$

The late part of each IR (the "reverberant path") are uncorrelated with each other:

$$E\{r_i^T(n)r_j(n)\}=0,$$

$$E\{s_{ri}^T(n)s_{dj}(n)\}=0,$$

The two reverberant path IR's are uncorrelated with both early parts:

$$E\{r_i^T(n)d_i(n)\}=0,$$

$$E\{s_{ri}^T(n)s_{di}(n)\}=0,$$

The reverberant path IR is decaying random noise with a normal distribution and a mean of zero:

$$E\{r_i(n)\}=0,$$

$$E\{s_{ri}(n)\}=0,$$

One possible function of any sound reproduction system is to play-back a sound recording. In a convention two-channel sound reproduction system (i.e. commonly referred to as a stereo system) having two speakers the microphone signals $m_1(n)$ and $m_2(n)$ are played for the listener(s) using left (L) and right speakers (R). With reference to 2B, and with continued reference to FIG. 1, shown is a simplified schematic illustration of the ASUS 13 for reproducing sound imagery true to the two microphone recording system shown in FIG. 2A in accordance with aspects of the invention. In this particular example, the first microphone M1 61 corresponds to the left channel (L) and the second microphone M2 63 corresponds to the right channel (R).

The left channel (L) is coupled in parallel to a delay element 77, an adaptive filter 71 and another delay element 73. Similarly, the right channel (R) is coupled in parallel to a delay element 78, an adaptive filter, and another delay element 74. The output of the delay element 77, being simply a delayed version of the left channel signal, is coupled to the front left speaker 21. Similarly, the output of the delay element 78, being simply a delayed version of the right channel signal, is coupled to the front right speaker 23.

In order to produce the reverberance channels for the left and right rear speakers 25 and 27, outputs of the adaptive filters are subtracted from delayed versions of signals from the corresponding adjacent front channel. Thus, in order to create the right reverberance channel $R_S$ the output of the adaptive filter 71, which produces a filtered version of the left channel signal, is subtracted from a delayed version of the right channel signal provided by the delay element 74 by way of the summer 75. Likewise, in order to create the left reverberance channel $L_S$ the output of the adaptive filter 72, which produces a filtered version of the right channel signal, is subtracted from a delayed version of the left channel signal provided by the delay element 73 by way of the summer 76.

The adaptive filters 71 and 72 are similar although not necessarily identical. To reiterate, in operation the ASUS 13, in some specific embodiments, operates in such a way that diagonally opposite speaker signals (e.g. L and $R_S$) are uncorrelated. For example, referring to FIG. 2B, such signals are $e_2(n)$ and $m_1(n)$. In other words, the output signal $e_i$ affected by adaptive filter $W_{ij}$ must be uncorrelated with the microphone channel which is not processed by this filter, mj. The procedure for updating the FIR adaptive filter so as to accomplish this is developed according to the principle of orthogonality which shall be explained shortly.

Each input signal $m_1$ and $m_2$ is filtered by an M-sample length filter ($w_{21}$ and $w_{12}$, respectively). As mentioned, these filters model the early component of the impulse response between the two microphone signals, so ideally $M=L_r$. However, for the foregoing analysis there are no assumptions about "knowing" $L_r$ a priori, so we will just call the time-domain filter size M. A delay is added to each input channel mi before the filtered signal $y_i$ is subtracted. This is to allow for non-minimum phase impulse responses which can occur if the sound source is closer to one microphone than the other. However, for the foregoing analysis we will not consider this delay as it makes the mathematical description more straightforward (and it would make no difference to the theory if it was included).

The filtering of signal $m_j$ by the adaptive filter $w_{ij}$ gives signal $y_i(n)$. This subscript notation may seem confusing, but helps describing the loudspeaker output signals because signal $m_i$ and $e_i$ are both phase-coherent (have a nonzero correlation) and are reproduced by loudspeakers on the same side (e.g. signals $m_i$ and $e_i$ are both reproduced with loudspeakers on the left-hand side). This filtering processing is shown in (4.11):

$$y_i(n) = \sum_{k=0}^{M-1} m_j(n-k) w_{i,j,k}, \tag{4.11}$$

which with the following definitions:

$$m_i(n)=[m_i(n), m_i(n-1), \ldots, m_i(n-M+1)]^T$$

$$w_{ij}=[w_{oj0}, w_{ij}, \ldots, w_{ij,M-1}]^T$$

allow the linear convolution to be written in vector form as:

$$y_i(n)=m_j^T(n)w_{ij}. \tag{4.12}$$

Figure 2B:
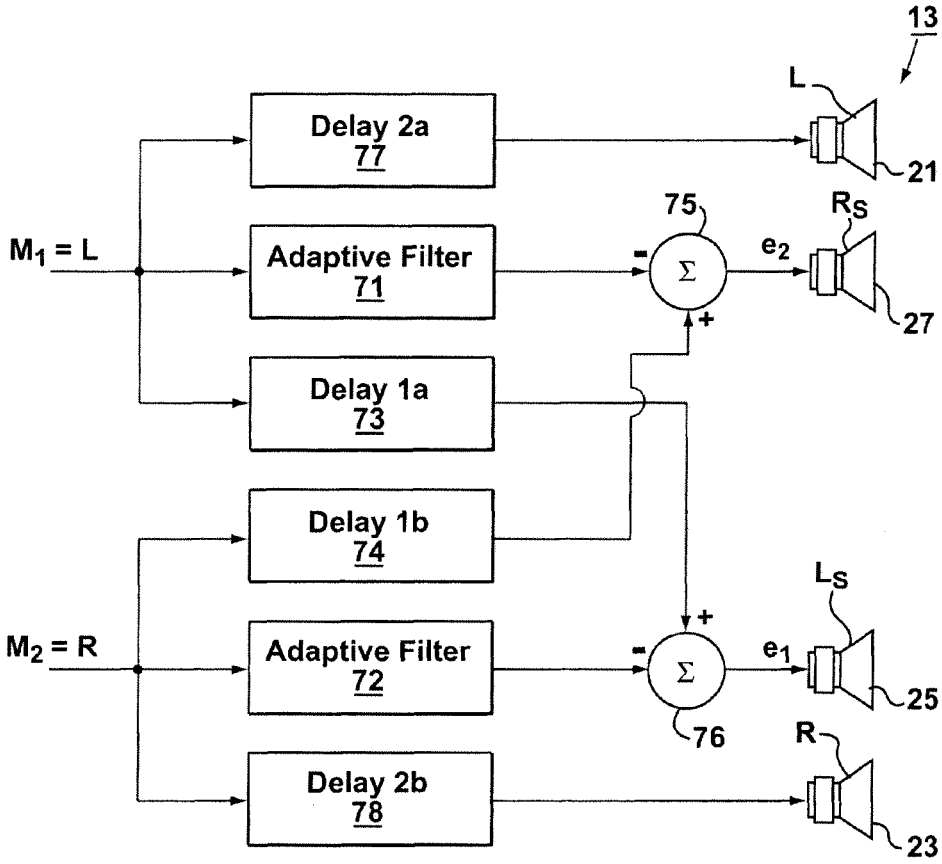
FIG. 2B is a simplified schematic illustration of an ASUS for reproducing sound imagery true to the two microphone recording system shown in FIG. 2A in accordance with at least one exemplary embodiment.

If we look at filter w12 in FIG. 2B, it is seen that the filtered m2 signal, y1 is subtracted from the unfiltered m1 signal (sample-by-sample) to give the error signal e1:

$$e_i(n)=m_i(n)-y_i(n). \tag{4.13}$$

The output signal is conventionally called an error signal as it can be interpreted as being a mismatch between yi and mi caused by the filter coefficients wij being "not-good enough" to model mi as a linear transformation of mj; these terms are used for the sake of convention and these two error signals are the output signals of the system which are reproduced with separate loudspeakers behind the listener.

If the filter coefficients wij can be adapted so as to approximate the early part of the inter-microphone impulse response, then the correlated sound component will be removed and the "left-over" signal will be the reverberant (or reverberance-image) component in the mj channel, plus a filtered version of the reverberant component in the mi channel. In this case, the error signal will be smaller than the original level of mj. The "goal" of the algorithm which changes the adaptive filter coefficients can therefore be interpreted as to minimize the level of the error signals. This level can simply be calculated as a power estimate of the output signal ei, which is an average of the squares of the individual samples, and it is for this reason that the algorithm is called the Least Mean Square (LMS) algorithm. This goal is formally expressed as a "performance index" or "cost" scaler J, where for a given filter vector wij:

$$J_i(w_{ij})=E\{e_i^2(n)\}, \tag{4.14}$$

and E {.} is the statistical expectation operator. The requirement for the algorithm is to determine the operating conditions for which J attains its minimum value; this state of the adaptive filter is called the "optimal state".

When a filter is in the optimal state, the rate of change in the error signal level (i.e. J) with respect to the filter coeffcients w will be minimal. This rate of change (or gradient operator) is a M-length vector ∇, and applying it to the cost function J gives:

$$\nabla J_i(w_{ij}) = \frac{\partial J_i(w_{ij})}{\partial w_{ij}(n)}, \tag{4.15}$$

The right-hand-side of (4.15) is expanded using partial derivatives in terms of the error signal e(n) from (4.14):

$$\frac{\partial J_i(w_{ij})}{\partial w_{ij}(n)} = 2E\left\{\frac{\partial e_i(n)}{\partial w_{ij}(n)} e_i(n)\right\}, \tag{4.16}$$

and the general solution to this differential equation, for any filter state, can be obtained by first substituting (4.12) into (4.13):

$$e_i(n) = m_i(n) - m_j^T(n)w_{ij}(n) \tag{4.17}$$

and differentiating with respect to wij(n):

$$\frac{\partial e_i(n)}{\partial w_{ij}(n)} = -m_j(n), \tag{4.18}$$

So (4.16) is solved as:

$$\nabla J_i(w_{ij})=-2E\{m_j(n)e_i(n)\}. \tag{4.19}$$

Updating the filter vector wij(n) from time n−1 to time n is done by multiplying the negative of the gradient operator by a constant scaler μ. The expectation operator in equation (4.19) is replaced with a vector multiplication and the filter update (or the steepest descent gradient algorithm) is:

$$w_{ij}(n)=w_{ij}(n-1)+\mu m_j(n)e_i(n), \tag{4.20}$$

It should be noted that the adaptive filtering algorithm which is used (i.e. based on the LMS algorithm) is chosen because of its relative mathematical simplicity compared with others.

From the filter update equation (4.20) it can be seen that the adjustment from wij (n−1) to wij(n) is proportional to the filtered input vector mj(n). When the filter has converged to the optimal solution, the gradient ∇ in (4~15) should be zero but the actual ∇ will be equal to μmj(n)ei(n). This product may be not equal to zero and results in gradient noise which is proportional to the level of mj(n). This undesirable consequence can be mitigated by normalizing the gradient estimation with another scaler which is inversely proportional to the power of mj(n), and the algorithm is therefore called the Normalized Least-Mean-Square (NLMS) algorithm. The tap-weight adaptation is then:

$$w_{ij}(n) = w_{ij}(n-1) + \frac{\alpha}{\delta + m_j^T(n)m_i(n)} m_j(n)e_i(n), \tag{4.21}$$

with $$0 < \alpha < 1.$$

When the input signals m1($n$) and m2($n$) are very small, inverting the power estimate could become computationally problematic. Therefore a small constant δ is added to the power estimate in the denominator of the gradient estimate—a process called regularization. How the regularization parameter affects filter convergence properties is investigated empirically with a variety of input signals in the next chapter.

As mentioned, when the "optimal state" is attained the gradient operator is equal to zero, so under these conditions at sample time n, (4.19) becomes:

$$E\{m_j(n)e_i(n)\}=0_{M\times 1}. \tag{4.22}$$

This last statement represents the Principle of Orthogonality (PoO). The elegant relationship means that when the optimal filter state is attained, e1 (the rear-left loudspeaker signal) is uncorrelated with m2 (the front-right loudspeaker signal). This means that when the adaptive filter is in its optimal solution, diagonally opposite loudspeaker signals are uncorrelated: Quod Erat Demonstrandum.

Under such a condition, distortion of the source image is minimized because signal ei contains reverberance-image components which are unique to mi, and as the source image is only affected by correlated components within mi and mj (by definition; correlated components within an approximately 20 ms window), then a radiated signal which is uncorrelated with either mi or mj can not contain a sound component which affects source imagery. This is a very important idea behind the ASUS, and the degree to which the PoO operates was by measuring both the electronic correlation between signals mj and ei and also the subjective differences in auditory spatial imagery of the source image within a conventional 2/0 audio scene and an upmixed audio scene created with the ASUS.

For optimal state conditions, using (4.17) to rewrite (4.22) and then expanding gives:

$$\begin{aligned} 0_{M\times 1} &= E\{m_j(n)e_i(n)\} \\ &= E\{m_j(n)(m_i(n) - m_j^T(n)w_{ij})\} \\ &= E\{m_j(n)m_i(n) - m_j(n)m_j^T(n)w_{ij}\}. \end{aligned} \tag{4.23}$$

These equations—called the normal equations because they are constructed using the equations supporting the corollary to the principle of orthogonality—can now be written in terms of the correlation between the input signals mj and mi, which is called the M-by-1 vector r:

$$\cdot r_{mjmj}=E\{m_j(n)m_j(n)\}$$

and the autocorrelation of each signal is the M-by-M matrix R:

$$\cdot R_{mjmj}=E\{m_j(n)m_i^T(n)\}.$$

This allows (4.23) to be expressed as:

$$0_{M\times 1}=r_{mjmj}-R_{mjmj}w_{ij}. \tag{4.24}$$

The filter in this state is called the Wiener solution and the normal equation becomes:

$$w_{ij}=R_{mjmj}^{-1}r_{mjmj} \tag{4.25}$$

Figure 3:
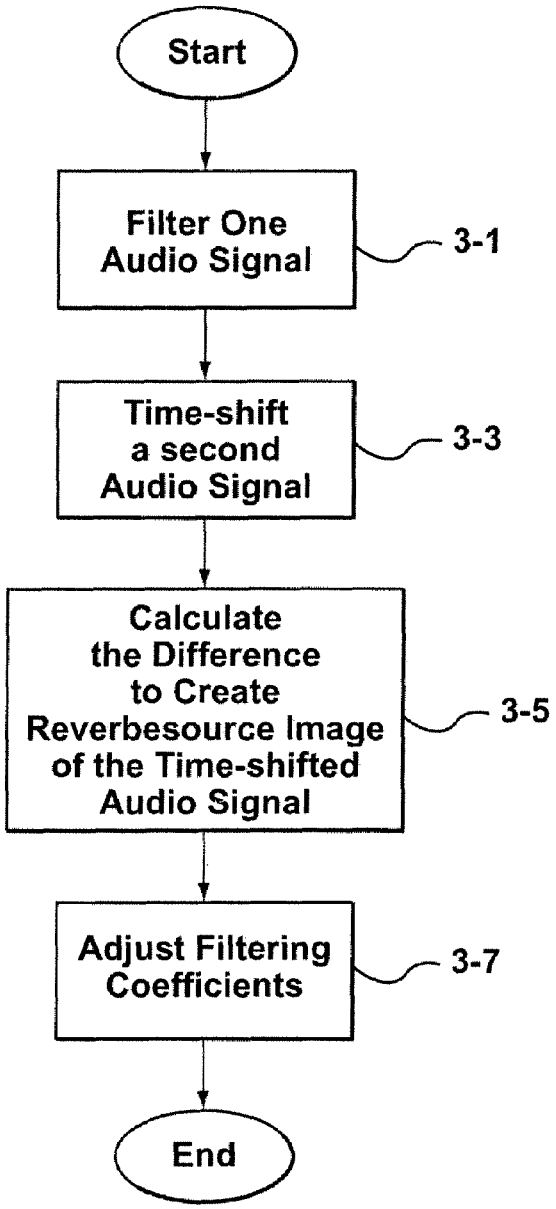
FIG. 3 is a flow-chart illustrating steps of a first method of upmixing audio channels in accordance with at least one exemplary embodiment.
Figure 4:
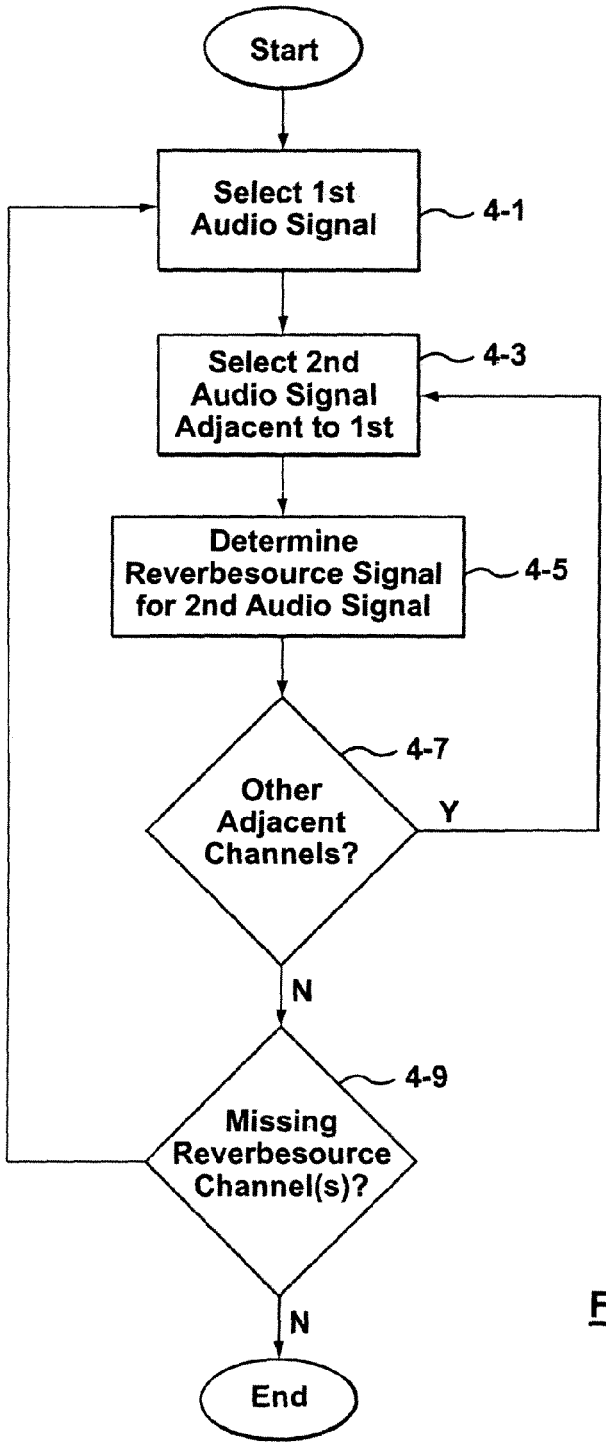
FIG. 4 is a flow-chart illustrating steps of a second method of upmixing audio channels in accordance with at least one exemplary embodiment.

For the sake of further clarity, the above description can be summarized using simplified flow-charts depicting only the broad and general steps of the operation of an ASUS in accordance with features of at least one exemplary embodiment. To that end FIGS. 3 and 4 are provided. FIG. 3 is a flow-chart illustrating steps of a first method of upmixing audio channels in accordance with features of at least one exemplary embodiment, and, FIG. 4 is a flow-chart illustrating steps of a second method of upmixing audio channels in accordance with features of at least one exemplary embodiment.

Referring first to FIG. 3, the first method includes filtering one of the audio channel signals at step 3-1 and time-shifting a second on the of audio channel signals at step 3-3. Step 3-5 includes calculating the difference between the filtered audio channel signal and the second time-shifted audio channel signal to create a reverberance audio signal. Finally, step 3-7 includes adjusting the filter coefficients to ensure/improve orthogonality.

Turning to FIG. 4, the second method includes selecting a first audio channel signal at step 4-1. Step 4-3 includes selecting a second audio channel signal adjacent to the first audio channel signal. Step 4-5 includes determining a reverberance audio channel signal for the second audio signal channel. Step 4-7 includes determining whether or not there are other adjacent channels to the first audio channel to be considered. If there is another adjacent channel to be considered (yes path, step 4-7), the method loops back to step 4-3. On the other hand, if there are no more remaining adjacent channels to be considered (no path, step 4-7), the method continues to step 4-9. Step 4-9 includes determining whether or not there are missing reverberance channel signals to be created. If there is at least one missing reverberance channel signal to be created (yes path, step 4-9), then the method loops back to step 4-1. On the other hand, if there are no more remaining reverberance channel signals to be created, then the method ends.

Figure 5:
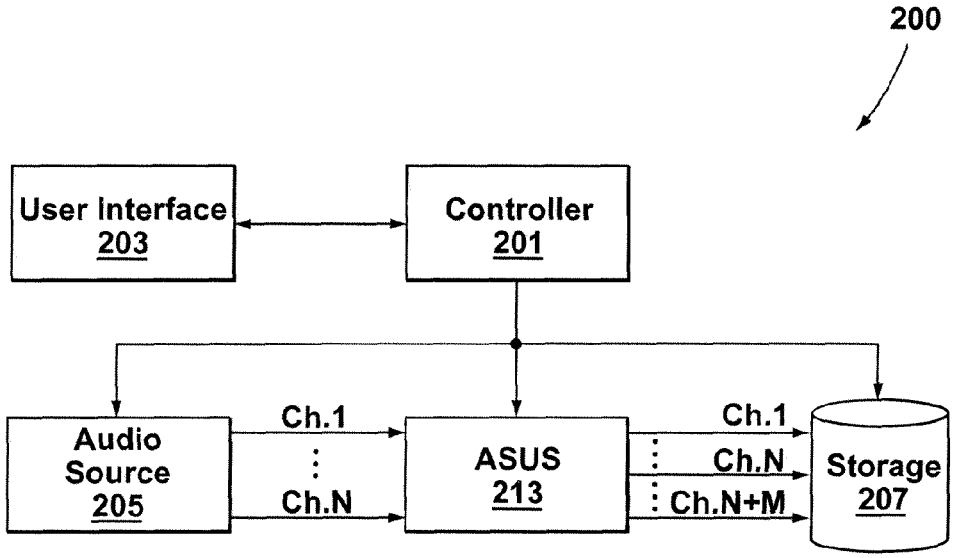
FIG. 5 is a system for creating a recording of a combination of upmixed audio signals in accordance with at least one exemplary embodiment.

In some exemplary embodiments the created reverberance channels are stored on a data storage medium such as a CD, DVD, flash memory, a computer hard-drive and the like. To that end, FIG. 5 is a system 200 for creating a recording of a combination of upmixed audio signals in accordance with aspects of the invention.

The system 200 includes a user interface 203, a controller 201, and an ASUS 213. The system 200 is functionally connectable to an audio source 205 having a number (N) of audio channel signals and storage device 207 for storing the original audio channel signals N and the upmixed reverberance channel signals (M) (i.e. on which the N+M are recorded). In operation a user uses the user interface 203 to control the process of upmixing and recording using the controller 201 and the ASUS 213. Those skilled in the art will understand that a workable system includes a suitable combination of associated structural elements, mechanical systems, hardware, firmware and software that is employed to support the function and operation of the. Such items include, without limitation, wiring, sensors, regulators, mounting brackets, and electromechanical controllers. At least one exemplary embodiment is directed to a method including: determining the level of panning between first and second audio signals, where the level of panning is considered hard if the first and second audio signals are essentially uncorrelated; and adjusting the introduced cross-talk to improve upmixing quality. For example . . . is an example of an improved upmixing quality.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed is:

1. A method of up-mixing audio signals comprising:

determining a level of panning between first and second audio signals, wherein the level of panning is considered hard if the first and second audio signals are essentially uncorrelated;

introducing cross-talk between the first and second audio signals thereby generating two new first and second audio signals;

filtering the first new audio signal, where the filtering includes use of a first set of filtering coefficients generating a filtered first audio signal;

time-shifting the second new audio signal, where the second new audio signal is time-shifted with respect to the filtered first audio signal generating a shifted second audio signal;

determining a first difference between the filtered first audio signal and the shifted second audio signal, where the first difference is an up-mixed audio signal;

adjusting the first set of filtering coefficients so that the first difference is essentially orthogonal to the first audio signal; and wherein introducing cross-talk comprises adjusting the introduced cross-talk based on the determined level of panning to improve up-mixing quality.

2. A method according to claim 1 wherein each of the first and second audio signals includes a source image component and a reverberance image component and wherein at least two of the respective source image components are correlated with one another.

3. A method according to claim 2 wherein the first and second audio signals include a left front channel and a right front channel and the first difference corresponds to a left rear channel including some portion of the respective reverberance image of the left front and right front channels.

4. A method according to claim 1 further comprising:

filtering the second new audio signal, where the filtering includes use of a second set of filtering coefficients generating a filtered second audio signal;

time-shifting the first new audio signal, where the first new audio signal is time-shifted with respect to the filtered second audio signal generating a shifted first audio signal;

determining a second difference between the filtered second audio signal and the shifted first audio signal; and adjusting the second set of filtering coefficients so that the second difference is essentially orthogonal to the second audio signal.

5. A method according to claim 1 wherein the first and second audio signals are adjacent audio channels.

6. A method according to claim 1 wherein the time-shifting includes one of delaying or advancing the first audio signal with respect to the second audio signal.

7. A method according to claim 6 wherein a time-shift value is in the range of about 2 ms to about 10 ms.

8. A method according to claim 1 wherein the filtering of the first audio signal includes equalizing the first audio signal so that the first difference is minimized.

9. A method according to claim 8 wherein the first set of filtering coefficients is adjusted according to one of the Least Means Squares (LMS) method or Normalized LMS (NLMS) method.

10. A device configured to up-mix audio signals comprising:

at least one audio signal input;

a hard panning detector;

a cross-talk inducer; and a computer-readable medium including a computer program, the computer program comprising:

employing the hard panning detector for determining a level of panning between first and second audio signals, wherein the level of panning is considered hard if the first and second audio signals are essentially uncorrelated;

employing the cross-talk inducer to iniect cross-talk into at least one of the first and second audio signals thereby generating two new first and second audio signals;

filtering the first new audio signal, where the filtering includes using a first set of filtering coefficients to generate a filtered first audio signal;

time-shifting the second new audio signal, where the second new audio signal is time shifted with respect to the filtered first audio signal generating shifted second audio signal;

determining a first difference between the filtered first audio signal and the shifted second audio signal, wherein the first difference is an up-mixed audio signal; and adjusting the first set of filtering coefficients so that the first difference is essentially orthogonal to the first audio signal, where the first and second audio signals are obtained through the at least one audio signal input, and where the at least one audio signal input and the computer-readable medium are operatively connected;

wherein the cross-talk inducer adjusts the introduced cross-talk to improve upmixing quality based on the level of panning between first and second audio signals determined by the hard panning detector.

11. The device according to claim 10 wherein the first and second audio signals include a left front channel and a right front channel and the first difference corresponds to a left rear channel including some portion of the reverberance image of the left front and right front channels.

12. The device according to claim 10 wherein the computer program further includes:

filtering the second new audio signal, where the filtering includes using a second set of filtering coefficients generating a filtered second audio signal;

time-shifting the first new audio signal, where the first new audio signal is time-shifted with respect to the filtered second audio signal generating a shifted first audio signal;

determining a second difference between the filtered second audio signal and the shifted first audio signal; and adjusting the second set of filtering coefficients so that the second difference is essentially orthogonal to the first audio signal.

13. The device according to claim 10 further comprising:

at least one audio output, where the at least one audio output can carry a plurality of output audio signals, where at least one output audio signal includes a combination of the first and second audio signals and at least one reverberance channel signal.

14. The device according to claim 10 further comprising a data storage device configured to store a plurality of output audio signals where at least one output audio signal includes a combination of the first and second audio signals and at least one reverberance channel signal.

15. The method according to claim 1, where the step of adjusting the first set of filtering coefficients includes adjusting the first set of filter coefficients using a time domain or frequency domain implementation of at least one of the LMS algorithm, the NLMS algorithm, and the affine projection algorithm.

16. The device according to claim 10, where the step of adjusting the first set of filtering coefficients includes adjusting the first set of filter coefficients using a time domain or frequency domain implementation of at least one of the LMS algorithm, the NLMS algorithm, and the affine projection algorithm.

17. A method according to claim 1 wherein each of the first and second audio signals includes a source right image component and a source left image component and wherein at least two of the respective source image components are correlated with one another.

18. The device according to claim 10 wherein each of the first and second audio signals includes a source right image component and a source left image component and wherein at least two of the respective source image components are correlated with one another.

* * * * *